US009057145B2

(12) United States Patent
Barthelmes et al.

(10) Patent No.: US 9,057,145 B2
(45) Date of Patent: Jun. 16, 2015

(54) ELECTRODEPOSITION METHOD WITH ANALYSIS OF THE ELECTROLYTIC BATH BY SOLID PHASE EXTRACTION

(75) Inventors: Jürgen Barthelmes, Berlin (DE); Robert Rüther, Oranienburg OT Lehnitz (DE); Florence Lagorce-Broc, Berlin (DE); Olaf Kurtz, Berlin (DE); Oleg Sprenger, Berlin (DE); Marta Sainz-Vila, Berlin (DE); Thomas Moritz, Berlin (DE); Josef Gaida, Berlin (DE)

(73) Assignee: Atotech Deutschland GmbH, Berlin (DE)

( * ) Notice: Subject to any disclaimer, the term of this patent is extended or adjusted under 35 U.S.C. 154(b) by 1287 days.

(21) Appl. No.: 12/312,940

(22) PCT Filed: Dec. 10, 2007

(86) PCT No.: PCT/EP2007/010753

§ 371 (c)(1),
(2), (4) Date: Aug. 25, 2009

(87) PCT Pub. No.: WO2008/071371

PCT Pub. Date: Jun. 19, 2008

(65) Prior Publication Data

US 2010/0059384 A1 Mar. 11, 2010

(30) Foreign Application Priority Data

Dec. 11, 2006 (EP) ..... 06025569

(51) Int. Cl.
*C25D 21/12* (2006.01)
*C25D 21/14* (2006.01)

(52) U.S. Cl.
CPC ..... *C25D 21/12* (2013.01); *C25D 21/14* (2013.01)

(58) Field of Classification Search
CPC ..... C25D 21/12; C25D 21/14; C25D 21/16; C25D 21/18
USPC ..... 205/81, 82, 101
See application file for complete search history.

(56) References Cited

U.S. PATENT DOCUMENTS 4,937,038 A * 6/1990 Sakai et al. ..... 376/245
5,296,128 A * 3/1994 Gernon et al. ..... 205/254

(Continued)

FOREIGN PATENT DOCUMENTS

EP 0 246 494 A1 11/1987
EP 1 369 680 A1 12/2003
JP 1-269052 A 10/1989
JP 2000-514704 A 11/2000

(Continued)

OTHER PUBLICATIONS

V. Camel et al., "Solid phase extraction of trace elements", Spectrochimica Acta Part B 58, pp. 1177-1233 (2003).

(Continued)

*Primary Examiner* — Bryan D. Ripa
(74) *Attorney, Agent, or Firm* — Mintz Levin Cohn Ferris Glovsky and Popeo, P.C.; Peter F. Corless; Christopher R. Cowles

(57) ABSTRACT

A method for electrodepositing a metal layer from an electrolytic bath is described, wherein the concentrations of at least two components of the electrolytic bath are monitored by carrying out the following steps: (a) a sample is taken from the electrolytic bath; (b) the sample is supplied to a column for solid phase extraction, which contains a solid sorbent material; (c) the column is subjected to a washing procedure with a first eluent, wherein the at least two components remain on the column, and undesired components are eluted from the column; (d) the at least two components are eluted from the column by a second eluent; (e) the concentrations of the at least two components in the eluate obtained in step (d) are determined without separating the components from each other. In this method the use of poly(divinyl benzene-co-N-vinyl pyrrolidone) for solid phase extraction is particularly advantageous.

14 Claims, 4 Drawing Sheets

(56) References Cited

U.S. PATENT DOCUMENTS

| | | | | |
|---|---|---|---|---|
| 6,605,204 | B1 * | 8/2003 | Martyak et al. | 205/123 |
| 6,645,364 | B2 * | 11/2003 | Calvert et al. | 205/81 |
| 2001/0035372 | A1 | 11/2001 | Bouvier et al. | |
| 2004/0000484 | A1 * | 1/2004 | Sun et al. | 205/81 |
| 2004/0003654 | A1 | 1/2004 | Nogent et al. | |
| 2005/0032231 | A1 | 2/2005 | Smaragdis | |
| 2005/0183958 | A1 * | 8/2005 | Wikiel et al. | 205/82 |
| 2006/0027456 | A1 * | 2/2006 | Harrison et al. | 204/451 |
| 2008/0237146 | A1 * | 10/2008 | Harrison et al. | 210/748 |

FOREIGN PATENT DOCUMENTS

| | | | |
|---|---|---|---|
| JP | 2003-222618 | A | 8/2003 |
| WO | 97/38774 | A2 | 10/1997 |

OTHER PUBLICATIONS

S. Baytak et al., "Determination of lead and nickel in environmental samples by flame atomic absorption spectrometry after column solid-phase extraction on Ambersorb-572 with EDTA", Journal of Hazardous Materials B129, pp. 130-136 (2006).

M. Tuzen et al., "Chromium speciation in environmental samples by solid phase extraction on Chromosorb 108", Journal of Hazardous Materials B129, pp. 266-273 (2006).

English Translation of International Preliminary Report on Patentability for International Application No. PCT/EP2007/010753.

D'Urzo et al., "SPE-HPLC detection of organic additives in acidic copper plating baths", *Journal of the Electrochemical Society*, vol. 152, pp. C243-C247 and C697-C700 (2005).

Johnson et al., "Reverse-Phase Liquid Chromatography—Determination of Additives in Birght Acid Tin Plating Solutions", *Metal Finishing*, pp. 49-52 (1985).

Partial English translation of Japanese Patent Laid-open Publication No. 1-269052.

* cited by examiner

ELECTRODEPOSITION METHOD WITH ANALYSIS OF THE ELECTROLYTIC BATH BY SOLID PHASE EXTRACTION

FIELD OF THE INVENTION

The present invention relates to a method for the electrodeposition of a metal layer from an electrolytic bath wherein the concentration of at least two components of the electrolytic bath is monitored by means of a column for solid phase extraction.

BACKGROUND OF THE INVENTION

The electrodeposition of metal layers from electrolytic baths has found various industrial applications. In addition to the metal or the metals to be deposited the electrolytic bath generally contains further components, which are required for performing the deposition method and for improving the quality of the deposited metal layer. These substances are organic compounds. Examples of such compounds are grain-refining agents, wetting agents, brighteners, complexing agents and inhibitors. In general, these components are more or less rapidly consumed, destroyed or removed from the bath by entrainment when the deposition method is carried out. Thus, the concentration of the components decreases more or less rapidly in the course of time. In order to enable an ideal execution of the deposition method over a longer period, it is necessary to monitor the concentration of one or more components of the electrolytic bath and to replace the consumed or destroyed amount of the component as required by adding fresh component to the electrolytic bath.

The monitoring of the concentration of the component(s) of an electrolytic bath requires the determination of the concentration of the component(s) in the electrolytic bath in regular time intervals. By now this has often been done in such a way that single samples are manually taken from the electrolytic bath, and these samples are subjected to a chemical and/or physical analysis optionally after concentrating and purifying the sample. Thereby the individual analysis steps of separating the additives, purifying and determining the concentrations are carried out separately. In addition to an increased amount of time required for this purpose and the resulting additional costs the result is available for an evaluation only after a significant time delay. The aim of ensuring an increased process security and enabling an immediate intervention in case of a change of the concentrations or concentration ratios or an increase in the concentration of the decomposition products of the additives in the electrolyte, can only be achieved to a very limited extent if it can be achieved at all. At the manufacturing site and, thus, at the site of sampling there is often no possibility to promptly perform the respective bath analysis. Hence, with respect to the execution of the analysis, which is of significant importance for the process controlling the quality of his products, the operator of the production site regularly has to rely on the assistance and the time schedule of a third party in case he does not intend to invest in appropriate analysis equipment and qualified personnel.

STATE OF THE ART

Solid phase extraction (SPE) is the most widely used method for concentrating and purifying samples, i.e. method for sample preparation in the field of modern liquid chromatography. It is particularly employed for the analysis of active principles in the pharmaceutical sector and in environmental technologies for concentrating the substances to be determined in water analytics.

For this purpose the components to be extracted are concentrated on particular adsorbing agents and subsequently eluted with a solvent. A reduced pressure can optionally be applied to the cartridges employed for this purpose.

Solid phase extraction has the significant advantage over liquid-liquid extraction (LLE) that it can be done with a by far smaller solvent volume, thereby achieving a higher concentration of the analyte within a shorter period. Moreover, the separation is more complete as compared with LLE, because the selection of adsorbing agent and eluent enables a wider polarity range and an ideal extraction of the desired components of the solution.

According to the state of the art, the above-mentioned concentration and purification of the sample is carried out as a separate step before the actual separation and determination of the substances of interest. This separation and determination is frequently carried out by a subsequent liquid chromatography (such as HPLC, HPLC), i.e. the preparation of the samples and the actual determination are carried out in several subsequent steps.

D'Urzo et al. (Journal of the Electrochemical Society, 152, 2005, p. C243 and p. C697) disclose the monitoring of two classes of organic additives in acidic copper baths by means of solid phase extraction and HPLC analysis comprising the following steps:

(a) taking a sample of the bath for depositing copper layers,
(b) solid phase extraction of the two additives to be determined in one step using a styrene/divinyl benzene column material,
(c) separating the additives by means of HPLC, and
(d) quantitative determination of the additive by means of UV spectrometry.

Johnson et al. (Metal Finishing, October 1985, p. 49) described the determination of three organic components that are used as additives in acidic tin baths, by (a) taking a sample,
(b) solid phase extraction,
(c) HPLC separation and
(d) UV detection.

The use of the elaborate HPLC step for separating the organic compounds prior to their quantitative determination is detrimental for the methods.

Quasi-continuously monitoring an electrodeposition process will be profitable in case the process and/or bath conditions change more rapidly than these conditions can be registered by conventional manual analysis and automation methods. This applies particularly with respect to processes having a narrow concentration range, small bath volumes and high throughputs (high deposition rate, carry over and entrainment of substances).

DESCRIPTION OF THE INVENTION

It is the object underlying the present invention to provide a method for electrodepositing a metal layer from an electrolytic bath, in which the concentration of at least two components of the electrolytic bath can be monitored in a simple way. In particular, the determination of the concentration of the at least two components shall be possible within a short time and by using small volumes of solvent. Thereby, quasi-monitoring the concentration of the at least two components shall be possible. Furthermore, it shall be possible to monitor the concentration of more components quasi-simultaneously.

These objects are solved by a method for electrodepositing a metal layer from an electrolytic bath, wherein the concentrations of at least two components of the electrolytic bath are monitored, wherein the following steps are carried out: (a) a sample is taken from the electrolytic bath; (b) the sample is applied the a column for solid phase extraction, which contains a solid sorbent material; (c) the column is subjected to a washing procedure using a first eluent, wherein the at least two components remain on the column, and undesired components are eluted from the column; (d) the at least two components are eluted from the column by means of a second eluent; (e) the concentration of the at least two components in the eluate obtained in step (d) are determined without separating the components from each other.

The present invention provides for the first time a method for the automatic quasi-continuous solid phase extraction of the components to be determined (in particular organic additives) with a subsequent direct determination of the concentrations without requiring the previous separation of the components.

The direct determination of the concentration of the components can be carried out by means of photometry, in particular UV detection, or by means of electrochemical detection methods, in particular polarography, or also by refractometry.

The present invention enables the analysis of the additives, particularly of tin, tin/lead, zinc, copper and nickel electrolytes as well as noble metal electrolytes, in particular n palladium and gold electrolytes.

DESCRIPTION OF PREFERRED EMBODIMENTS

Figure 1:
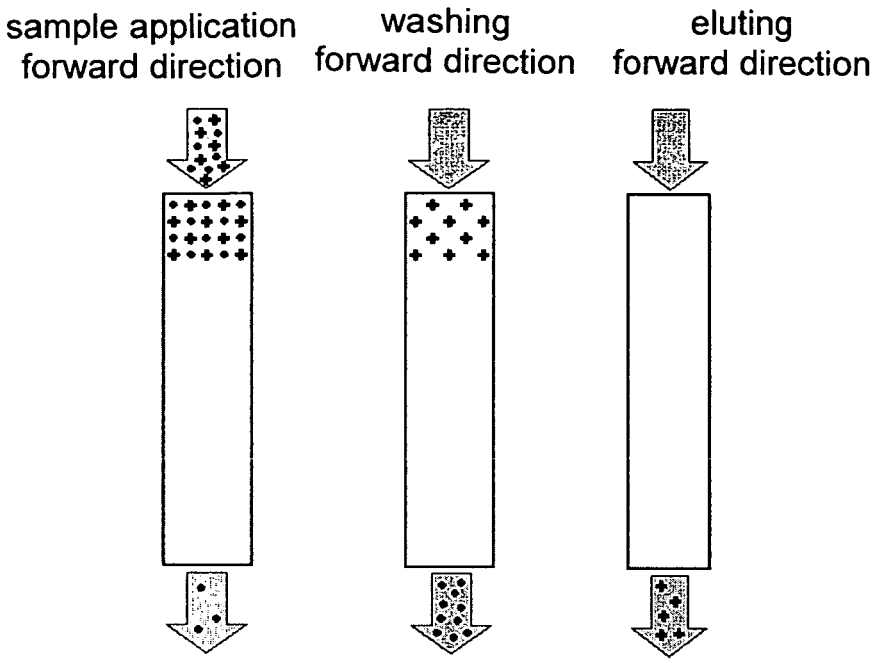
FIG. 1 is a schematic representation of the steps of sample is application, washing and eluting the column for solid phase extraction according to an embodiment of the method according to the present invention.

The present invention provides a method for electrodepositing a metal layer from an electrolytic bath. The metal to be deposited is not particularly limited. In particular, the metal can be tin, tin/lead, zinc, copper, nickel and a noble metal such as palladium or gold or a combination of these or other metals.

The method according to the present invention enables the monitoring of the concentrations of at least two components of the electrolytic bath. These components are preferably organic components of the electrolytic bath. In particular, flavones, chalcones, maltols, napthols and UV active ionic and non-ionic surfactants are among the components, the concentration of which can be monitored. A component, the concentration of which is monitored, may also be a grain-refining agent. The grain-refining agent can particularly be morin, which is used for example in electrolytic baths for electrodepositing tin layers. The component can further be a usual additive, which is employed in electrolytic baths for depositing tin layers.

In particular the components, the concentration of which is monitored, are non-polar substances.

As mentioned, the components, the concentration of which is monitored, can be UV-active ionic or non-ionic surfactants. Non-ionic surfactants having a chromophoric group that absorbs in a wavelength range of 200-800 nm are preferred. Ethoxylated aromatic compounds such as, for example, ethoxylated alkyl phenol derivatives, ethoxylated bis-phenols as well as ethoxylated fused aromatic compounds are further preferred.

In the method according to the present invention the concentration of at least two components of the electrolytic bath can be monitored. Therein, the steps of sampling, solid phase extraction, the washing procedure and eluting for the component to be monitored are preferably carried out simultaneously or in parallel. The determination of the concentrations of the components is carried out without separating the components from each other. However, the determination of the concentration of the particular components is not necessarily carried out simultaneously but usually subsequently. However, the determination of the concentration of the particular components is preferably carried out in one measurement cycle.

In case of determining the components in subsequent analysis steps different sample volumes can be employed for each of the components to be monitored depending on the concentration of the respective component and the sensitivity of the employed detection method.

The method according to the present invention particularly enables the monitoring of components that significantly differ from each other with respect to their concentration in the electrolytic bath and/or with respect to their absorption coefficient $\epsilon$ and, thus, which cannot be determined simultaneously with conventional methods.

In the method according to the present invention a sample is taken from the electrolytic bath first. This can particularly be carried out by drawing a small partial volume of the electrolytic bath via a pump.

The sample is then supplied to a column for solid phase extractions, which contains a solid sorbent material. The sorbent material is selected according to the dissolution character, the polarity, the hydrophilic character and the lipophilic character of the substances to be separated. The macromolecular skeleton of the sorbent material is preferably a copolymer of divinyl benzene and N-vinyl pyrrolidone or a crosslinked polystyrene (obtained by copolymerising styrene with divinyl benzene). The sorbent material can also consist of silica (silica gel).

A particularly good separation effect of the components to be determined from the aqueous matrix of the electrolytic bath has surprisingly been demonstrated in particular for the copolymer of divinyl benzene and N-vinyl pyrrolidone (i.e. poly(divinyl benzene)-co-N-vinyl pyrrolidone). Furthermore, this copolymer is particularly distinguished both by hydrophilic and lipophilic retention characteristics, thereby enabling the use of aqueous, polar and non-polar solvents for extracting the analyte. Thus, a particularly wide range of applications is covered.

The average pore diameter of the poly(divinyl benzene-co-N-vinyl pyrrolidone), which can be used as an example of the sorbent material, preferably amounts to about 82 Å, the specific surface area preferably amounts to about 831 $m^2/g$, the pore volume preferably amounts to about 1.4 $cm^3/g$, the average particle diameter preferably amounts to about 31.4 μm and the content of fine particles (<10 μm) is preferably about 0.1%. Poly(divinyl benzene-co-N-vinyl pyrrolidone)s having these properties are commercially available (e.g. from Waters Corporation).

Up to now poly(divinyl benzene-co-N-vinyl pyrrolidone) has not found any application in the field of electrodeposition.

Further suitable column materials are on silica basis, in particular RP18 (lipophilic character). RP18 means "reversed phase" with 18 carbon atoms in the side chain. This designation is used for a particular stationary phase for liquid chromatography. In the case of RP phases the polarity proportions are reversed as compared to normal phases. Non-polar side chains are linked to a silica gel skeleton or to a polymer. In general, column materials on silica bases with 8 to 18 carbon atoms can be employed.

In the vicinity of the inlet aperture of the column a high concentration of the components to be monitored occurs in solid phase extraction.

Then the column is objected to a washing procedure using a first eluent, wherein the at least two components to be monitored remain on the column and undesired components are eluted from the column. In particular the following can be used as the first eluent for this purpose: water, diluted acid, methane sulfonic acid, acetates, carbonates, bases or mixtures thereof, a mixture of alcohol and sulfuric acid or a mixture of alcohol and water. These eluents are selected depending on the dissolution character, the polarity, the hydrophilic character and lipophilic character of the substances to be separated.

The washing procedure additionally serves to wash out or filter out impurities and larger particles, which are not capable of passing the column with the aqueous matrix. Such particles would otherwise reach the measurement chamber in the subsequent elution step and negatively affect the measurement in the measurement chamber.

Subsequently, the at least two components to be monitored are eluted from the column by means of a second eluent. In particular, the following can be employed as the second eluent: water, methanol, a mixture of water and methanol, alkanes, methylchloride, alcohols, dimethylsulfoxide, acetonitrile or mixtures thereof. The eluents are selected depending on the dissolution character, the polarity, the hydrophilic character and the lipophilic character of the substances to be separated.

Preferably the second eluent is less polar than the first eluent. In particular, the second eluent is selected such that its polarity is sufficient to elute the two components to be monitored from the column.

The first eluent and the second eluent can be supplied to the column in the same direction as the previously supplied sample of the electrolytic bath (cf. FIG. 1). This direction is herein referred to as the "forward" direction.

Figure 2:
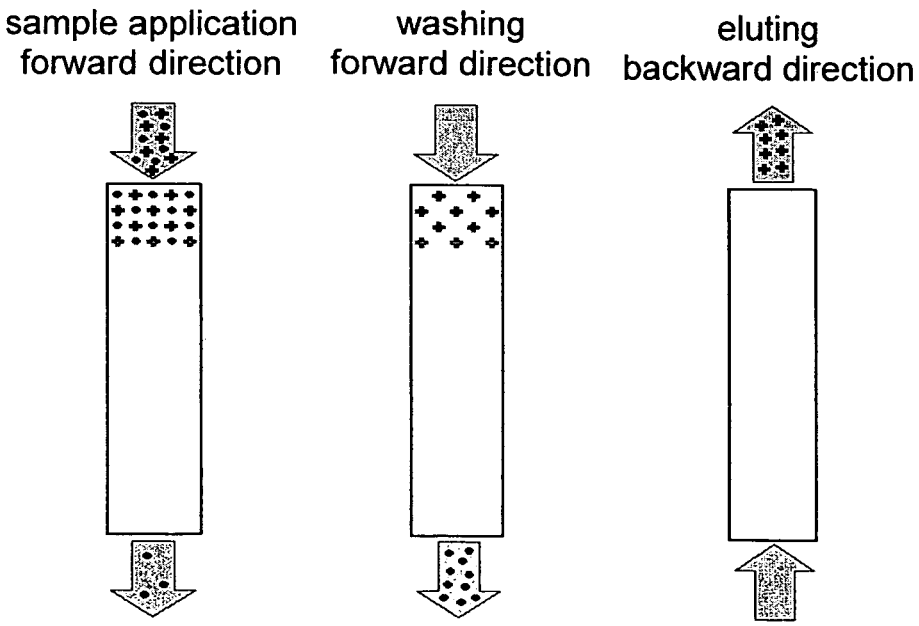
FIG. 2 shows a schematic representation of the steps of sample application, washing and eluting the column for solid phase extraction according to a further embodiment of the method according to the present invention.
Figure 3:
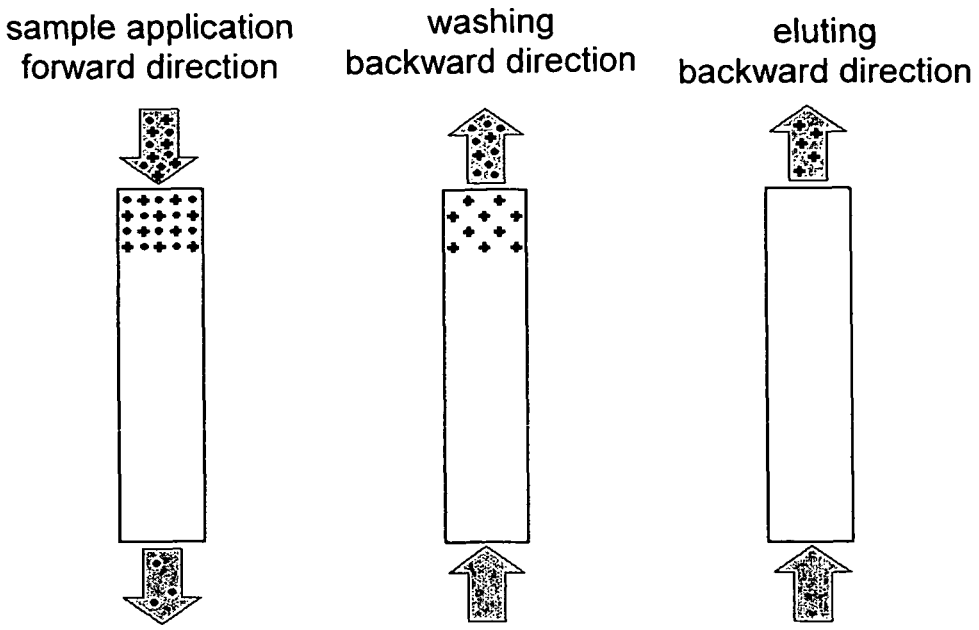
FIG. 3 shows a schematic representation of the steps of sample application, washing and eluting the column for solid phase extraction according to a further embodiment of the method according to the present invention.

Alternatively, the first eluent and/or the second eluent can be supplied to the column in the opposite direction (cf. FIGS. 2 and 3). This direction is herein referred to as the "backward" direction.

Figure 4:
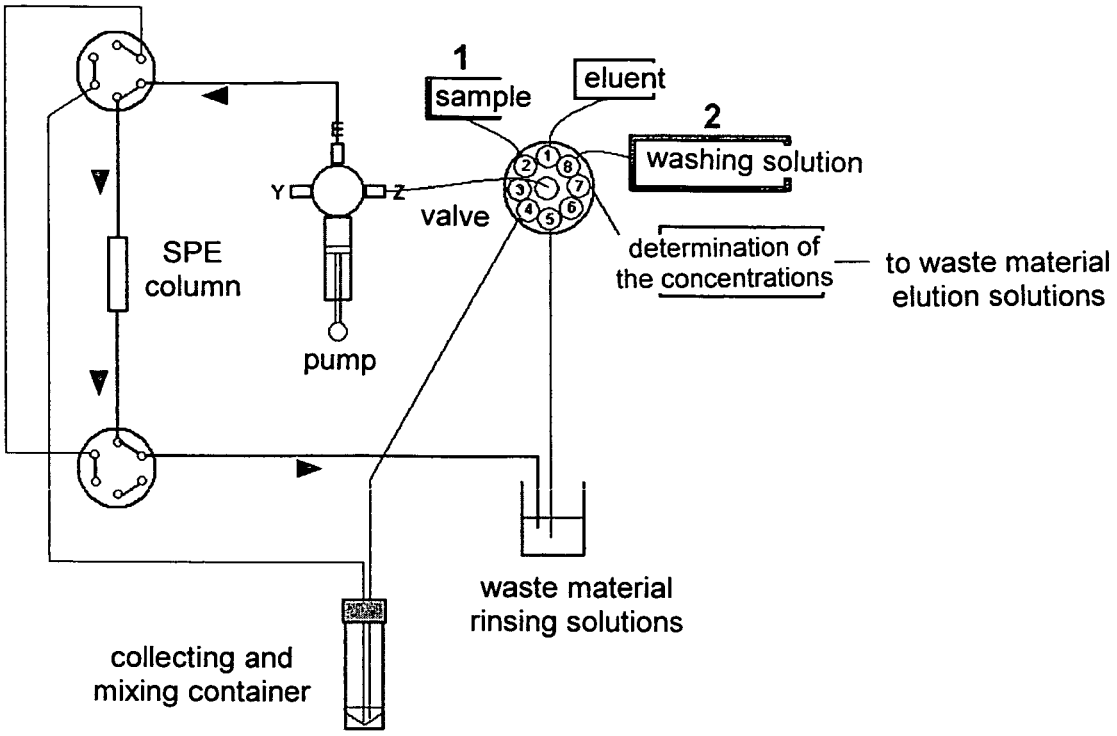
FIG. 4 shows a schematic representation of an analysis system for the method according to the present invention including control valves, wherein the sample or a washing solution is passed over the column in forward direction, and an optional collecting and mixing container is provided.
Figure 5:
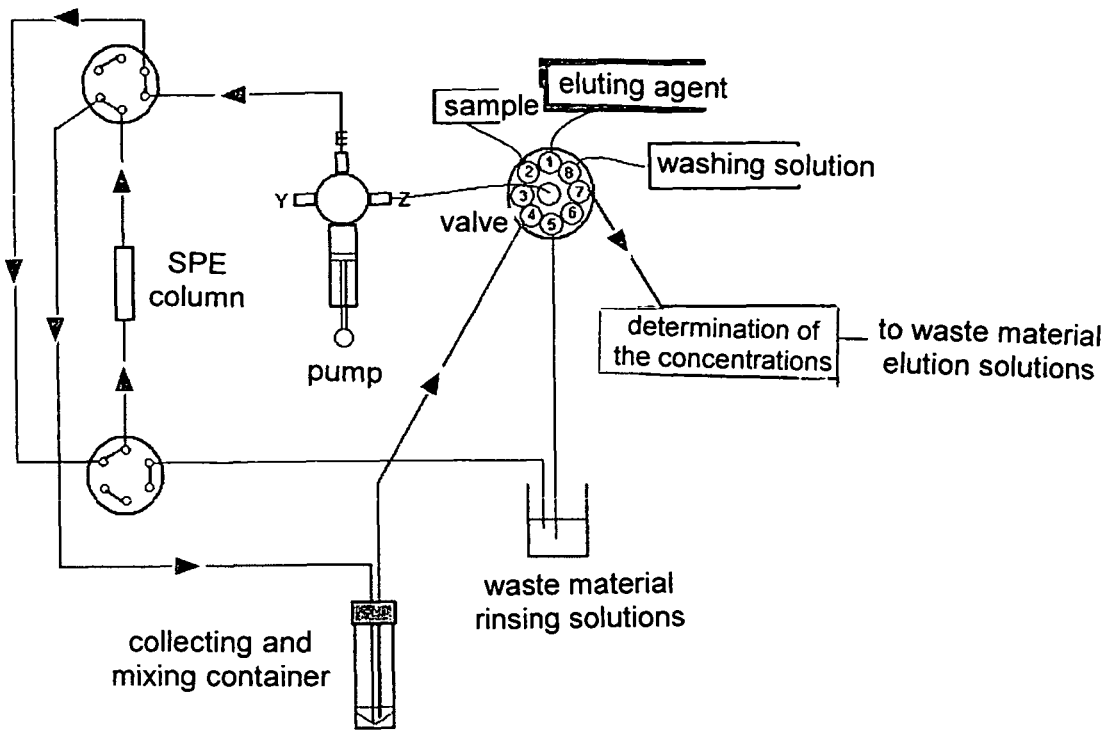
FIG. 5 shows a schematic representation of an analysis system for the method according to the present invention including control valves, wherein the eluent is passed over the column for solid phase extraction in backward direction, and an optional collecting and mixing container is provided.

The inversion of the elution direction can be achieved in a simple manner by means of control valves as illustrated in FIGS. 4 and 5. The valve adjustment enables the adjustment of the flowing direction. This embodiment of the method is preferred. In particular, in this embodiment a collecting and mixing container can be provided in order to dilute the eluate before the measurement in case its concentration is too high.

By inverting the elution direction, the extended passage through the column is avoided in case of maintaining the flowing direction during the elution. Thereby, the discharge path of the components to be monitored or the undesired components is shortened and the time for the analysis is significantly reduced. Furthermore, the reproducibility of the values is significantly improved thereby.

Finally, the concentrations of the at least two components to be monitored in the eluate obtained by eluting with the second eluent are determined. From the concentration in the eluate the concentration of the component in the electrolytic bath can be calculated (on the basis of the volume of the eluate and the volume of the initially applied sample).

The determination of the concentrations can be carried out photometrically. In this case the eluate obtained by the elution with the second eluent is supplied to a measuring cell where preferably UV light is irradiated in perpendicular direction to the flowing direction from an external source, detected by a photometer and recorded via a computer program. The at least two components do not have to be separated from each other for this purpose. It is rather possible to determine the concentrations of different components separately by using light having different wavelengths without separating the components. The determination of the concentrations of the particular components can be carried out consecutively. The determination of the concentrations of the particular components can also be carried out in different devices and by using different sample volumes. However, a separation of the at least two components to be monitored prior to the determination of their concentration as carried out in known methods preferably by means of chromatographic methods, is not required in the method according to the present invention.

In contrast, in the method according to the present invention a physical measuring method is selected, in which the physical parameters of the at least two components differ from each other such that a determination can be carried out without separating the components.

In particular, suitable physical measuring methods for this purpose comprise the following:

- photometry wherein two components differ from each other is with respect to their extinction coefficient $\epsilon$,
- polarography wherein the two components differ from each other with respect to their half-wave potential, which is a characteristic parameter for the type of the depolariser (analyte) in the selected supporting electrolyte,
- refractometry wherein the two components differ from each other with respect to their refractive index $\eta$.

Further suitable measuring methods for determining concentrations comprise electroanalytical methods such as coulometry and voltametry. Furthermore, mass spectrometry is suitable for determining the concentrations.

In a preferred embodiment of the method according to present the invention the column is subjected to a conditioning treatment prior to supplying the sample of the electrolytic bath. In particular, the following can be employed as means for conditioning: methanol or an acid-containing solution.

The use of acid-containing conditioning solutions is particularly advantageous in order to precipitate hardly soluble substances and, thus, to avoid plugging of the column. After conditioning or activating and before supplying the sample of the electrolytic bath, the column is equilibrated with water.

In the method according to the present invention the concentration of at least two components of an electrolytic bath can be monitored quasi-continuously. The term "quasicontinuous" as used herein means that the determination of the concentrations is regularly repeated in comparatively short intervals. The interval can be, for example, 10 hours, 5 hours, 2 hours, 1 hour, 30 minutes, 10 minutes or 1 minute. In the method according to the present invention monitoring the concentration of the at least two components of the electrolytic bath can be preferably carried out automatically. The term "automatic" as used herein means that all the steps of the method are carried out without manual intervention.

In an preferred embodiment of the method according to the present invention the monitoring of the at least two components is combined with the control of a dosing system, which supplies a fresh amount of the consumed or decomposed component to the electrolytic bath depending on the demand in order to ensure an almost constant concentration of the monitored components throughout the execution of the deposition method. In the ideal case a stationary state is achieved, in which all constituents, the concentration of which decreases, are supplemented by a suitable dosing system, and the constituents, the concentration of which increases, are removed by corresponding regeneration measures.

The method according to the present invention can easily be handled and provides a cost-efficient alternative to manual sampling with subsequent concentration of the sample and final determination of the concentrations and to known methods including the separation of the components to be monitored. The cost-efficiency, the quality as well as the provision of a quality confirmation and the trouble shooting in the running production are demonstrably improved by the monitoring according to the present invention.

The present invention enables for the first time a highly efficient, cost-efficient, easy to handle and highly reproducible monitoring of at least two components of electrolytic baths in the field of electrodeposition.

EXAMPLES

In the following the present invention is further illustrated by means of non-limiting examples.

The concentration of the components:

1. grain-refining agent (morin)
2. additive (polymer, ethoxylated bis-phenol as a non-ionic surfactant)

of an electrolytic bath for depositing tin layers (StannoPure HSM⁻ of Atotech Deutschland GmbH) was monitored.

For this purpose an Oasis HLB-Plus column (from Waters Corporation, column size: 4.6×21 mm, particle diameter: 25 μm) was used for solid phase extraction.

For monitoring the concentration of the grain-refining agent, the following steps were carried out:

1. conditioning the column with 2.5 ml methanol
2. equilibrating with 2.5 ml VE water (completely deionised water)/3.25 ml/l MSA (methane sulfonic acid, 70%)
3. sample application (sample volume: 1.0 ml)
4. washing with 5 ml VE water/3.25 ml/l MSA (70%)
5. eluting with 1.0 ml methanol
6. photometric determination at 416-550 nm For monitoring the concentration of the additive, the following steps were carried out:

1. conditioning the column with 2.5 ml methanol
2. equilibrating with 2.5 ml VE water/3.25 ml/l MSA (70%)
3. sample application (sample volume: 0.05 ml)
4. washing with 5 ml VE water/3.25 ml/l MSA (70%)
5. eluting with 10 ml methanol, discarding 9 ml of the eluate and adding 2 ml methanol
6. photometric determination at 226 nm

The invention claimed is:

1. Method for electrodepositing a metal layer from an electrolytic bath, wherein the concentrations of at least two components of the electrolytic bath are monitored, wherein the following steps are carried out:

(a) a sample is taken from the electrolytic bath;

(b) the sample is supplied to a column for solid phase extraction, which contains a solid sorbing agent;

(c) the column is subjected to a washing procedure with a first eluent, wherein the at least two components remain on the column, and undesired components are eluted from the column;

(d) the at least two components are eluted from the column by a second eluent;

(e) the concentrations of the at least two components in the eluate obtained in step (d) are determined by photometry, polarography or refractometry without separating the at least two components from each other and without use of high performance liquid chromatography, wherein the monitoring of the concentration of the at least two components is carried out in combination with a dosing system, which, depending on the result of the determination of the concentrations, supplies the corresponding fresh amount of the at least two components; and wherein the sequence of steps (a) to (e) is repeated at regular intervals of one minute to 10 hours.

2. Method according to claim 1, wherein the metal is tin, zinc, copper, nickel or a noble metal.

3. Method according to claim 2, wherein the noble metal is palladium or gold.

4. Method according to claim 1, wherein the at least two components to be monitored are selected from the group consisting of flavones, chalcone, maltol, naphtol, and UV-active non-ionic surfactants.

5. Method according to claim 1, wherein at least one of the at least two components to be monitored is a grain-refining agent.

6. Method according to claim 5, wherein the grain-refining agent is morin.

7. Method according to claim 1, wherein the sorbing agent is a copolymer of divinyl benzene and N-vinyl pyrrolidone.

8. Method according to claim 1, wherein the first eluent is water, a diluted acid, a mixture of alcohol and sulfuric acid or a mixture of alcohol and water.

9. Method according to claim 1, wherein the second eluent is water, methanol, a mixture of water and methanol or acetonitrile.

10. Method according to claim 1, wherein the supply of the first eluent to the column in step (c) is carried out in the same direction as the supply of the sample in step (b).

11. Method according to claim 1, wherein the supply of the first eluent to the column in step (c) is carried out in opposite direction to the supply of the sample in step (b).

12. Method according to claim 1, wherein the supply of the second eluent to the column in step (d) is carried out in the same direction as the supply of the sample in step (b).

13. Method according to claim 1, wherein the supply of the second eluent to the column in step (d) is carried out in opposite direction to the supply of the sample in step (b).

14. Method according to claim 1, wherein a conditioning treatment of the column with methanol or an acid-containing solution and a subsequent equilibration of the column with water is carried out prior to step (b).

* * * * *